US006786860B2

(12) United States Patent
Maltan et al.

(10) Patent No.: US 6,786,860 B2
(45) Date of Patent: Sep. 7, 2004

(54) HEARING AID DESIGN

(75) Inventors: Albert A. Maltan, Stevenson Ranch, CA (US); Alfred E. Mann, Beverly Hills, CA (US); James P. McGivern, Stevenson Ranch, CA (US); Philip H. Lee, Santa Clarita, CA (US)

(73) Assignee: Advanced Bionics Corporation, Valencia, CA (US)

( * ) Notice: Subject to any disclaimer, the term of this patent is extended or adjusted under 35 U.S.C. 154(b) by 0 days.

(21) Appl. No.: 10/264,962

(22) Filed: Oct. 3, 2002

(65) Prior Publication Data

US 2003/0086583 A1 May 8, 2003

Related U.S. Application Data

(60) Provisional application No. 60/338,975, filed on Dec. 7, 2001, and provisional application No. 60/327,100, filed on Oct. 3, 2001.

(51) Int. Cl.[7] ..... H04R 25/00

(52) U.S. Cl. ..... 600/25

(58) Field of Search ..... 600/25; 387/328, 387/330, 322, 382, 380; 607/55–57

(56) References Cited

U.S. PATENT DOCUMENTS

| | | | | |
|---|---|---|---|---|
| 3,068,954 | A | 12/1962 | Strzalkowski | |
| 3,557,775 | A | 1/1971 | Mahoney | |
| 3,844,271 | A | 10/1974 | Lake | |
| 4,957,478 | A | 9/1990 | Maniglia | |
| 5,015,224 | A | 5/1991 | Mniglia | |
| 5,411,467 | A | 5/1995 | Hortmann et al. | |
| 5,430,801 | A | 7/1995 | Hill | |
| 5,814,095 | A | 9/1998 | Muller et al. | |
| 5,833,626 | A | 11/1998 | Leysieffer | |
| 5,999,632 | A | 12/1999 | Leysieffer et al. | |
| 6,022,311 | A | 2/2000 | Juneau et al. | |
| 6,094,493 | A | 7/2000 | Borowsky et al. | |
| 6,099,462 | A | 8/2000 | a Wengen | |
| 6,164,284 | A | 12/2000 | Schulman et al. | |
| 6,185,452 | B1 | 2/2001 | Schulman et al. | |
| 6,208,894 | B1 | 3/2001 | Schulman et al. | |
| 6,228,020 | B1 | 5/2001 | Juneau et al. | |
| 6,254,526 | B1 | 7/2001 | Juneau et al. | |
| 6,259,951 | B1 * | 7/2001 | Kuzma et al. | 607/57 |
| 2001/0053871 | A1 | 12/2001 | Zilberman et al. | |
| 2001/0053872 | A1 | 12/2001 | Zilberman et al. | |
| 2001/0056291 | A1 | 12/2001 | Zilberman et al. | |
| 2003/0031336 | A1 | 2/2003 | Harrison et al. | |

FOREIGN PATENT DOCUMENTS

| | | |
|---|---|---|
| DE | 19854360 A1 | 8/1999 |
| DE | 19943907 A1 | 3/2001 |
| DE | 20018528 U1 | 4/2001 |
| DE | 20108827 U1 | 10/2001 |

OTHER PUBLICATIONS

Retro–X Technology, Auric Hearing Systems, "Das Horsystem Mit Retroauricularer Schallfuhrung", printed Sep. 27, 2001, 1 page.

* cited by examiner

*Primary Examiner*—John P. Lacyk
(74) *Attorney, Agent, or Firm*—Laura Haburay Bishop; Bryant K. Gold

(57) ABSTRACT

A hearing aid module (60) is shaped for insertion into a tunnel (40) made through the soft tissue that connects the retro-auricular space (50) with the ear canal (30). A hollow tube (44) may first be chronically or acutely implanted in such tunnel, and the hearing aid module inserted into the tube. The tube or hearing aid module may have a coating (45) containing a steroid or drug adapted to minimize infection and/or inflammation. The hearing aid module contains a speaker (65), a battery or other power source (66) powering the module, signal processing circuitry (67), and a microphone (63). Telemetry circuitry (69) within the module allows the signal processing circuitry to be programmed with a desired frequency response or signal processing strategy using an external programming unit (74). A remote control unit (75) permits the user to make simple adjustments, such as volume and/or tone control.

29 Claims, 4 Drawing Sheets

HEARING AID DESIGN

The present application claims the benefit of U.S. Provisional Patent Applications Serial No. 60/327,100, filed Oct. 3, 2001, and Serial No. 60/338,975, filed Dec. 7, 2001, which applications are incorporated herein by reference in their entirety.

FIELD OF THE INVENTION

The present invention relates to hearing aid systems, and more particularly to a hearing aid system that uses a tunnel, or a tube inserted into such a tunnel, made through soft tissue in order to connect the retro-auricular space behind the pinna to the ear canal. A hearing aid module is inserted into the tube or tunnel. The hearing aid module detects sound through a microphone positioned at the retro-auricular end of the module or inside the module, amplifies such sound, and directs the amplified sound through the tube or tunnel directly into the ear canal.

BACKGROUND OF THE INVENTION

Traditionally, most hearing aids capture sound through a microphone that is located inside or on top of the pinna of the ear, and deliver an amplified and/or modified version of the sound signal into the user's ear canal through a suitable electrical-to-audio transducer, e.g., a small speaker. Disadvantageously, the proximity of the microphone to the transducer poses the potential problem of feedback from the transducer to the microphone.

The solution in the past for eliminating feedback has been to occlude the ear canal via an ear mold such that the transducer is located distally to the occlusion, while the microphone is located proximally to the occlusion. Unfortunately, occlusion of the ear canal can create several disadvantages for the user, such as reverberation and physical discomfort, and is a major cause for non-use of traditional hearing aids by the hearing impaired.

In addition, it is desirable to make hearing aids less visible, as most users perceive the aid as imparting a negative stigma. Thus, hearing aids are continuously becoming smaller and have moved from behind the ear into the outer ear and into the canal of the ear.

It is known in the art to connect the retro-auricular space (space behind the pinna of the ear) to the ear canal via a hollow titanium tube that is permanently placed into soft tissue. See, e.g., U.S. Pat. No. 6,094,493, which patent is incorporated herein by reference. In one embodiment presented in the '493 patent, an amplification hearing aid is connected to the proximal (retro-auricular) end of the tube, whereby the hearing aid is located behind the pinna of the ear and a transducer sends the amplified sound signal through the tube into the ear canal. This concept, which has been commercialized by Auric® Hearing Systems, Inc. of Charlotte, N.C. as the RetroX technology, allows a certain degree of amplification without feedback and without the need for occlusion of the ear canal. In another embodiment of the '493 patent, the microphone, transducer, electrical and electronic components are installed in the tube. The existing technology suffers from infection and inflammation in the area of the tube, among other things.

Several concepts for implanting all or part of the hearing aid into the middle ear have been developed. Such approaches couple an amplified and processed version of the sound signal to structures of the middle ear mechanically, thereby reducing feedback without occlusion of the ear canal. Such systems also reduce or eliminate visibility of the hearing aid, and have the potential for improving user comfort. Disadvantageously, however, such middle-ear-coupled systems require, inter alia, a significant surgical procedure.

In U.S. Pat. No. 5,430,801, the use of a silicone tube is disclosed to direct the output of a conventional hearing aid, held in place behind the ear using an ear-hook or via a piercing through the cartilage of the pinna, into the ear canal. One embodiment disclosed in the '801 patent contemplates placing the distal end of the tube in the middle ear to achieve better gain. However, such embodiment, like all middle-ear devices, involves a significant surgical procedure, and the risk of infection is much greater than a simple piercing of the soft tissue behind the ear. Further, the microphone associated with the hearing aid disclosed in the '801 patent is held at the front of the pinna, either as part of the piercing or connected to the hearing aid through an earring-type coupler.

It is thus seen that what is needed is a hearing aid that is less visible, smaller, and which is positionable so that part or all of the hearing aid is recessed or implanted in the body so as to be largely invisible, and which does not occlude the ear canal. Moreover, what is needed is such a hidden, non-occluding hearing aid that can be readily removed for battery recharging or replacement. Furthermore, such a hearing aid should provide protection from infection and/or inflammation in the area of the aid.

SUMMARY OF THE INVENTION

The present invention addresses the above and other needs by providing a hearing aid module shaped so it can be inserted into a tunnel made through the soft tissue that connects the retro-auricular space with the ear canal.

The hearing aid module has the size and shape needed for it to fit in the soft tissue tunnel because it takes advantage of the availability of smaller batteries or other power sources, advances in microelectronic components, and advanced mechanical design capability. The hearing aid module contains a speaker, located on the distal part of the module so as to reside close to or inside the ear canal, a battery or other power source that powers the module, signal processing circuitry, and a microphone. The microphone is located at the proximal part of the module so as to reside close to or in the retro-auricular space behind the pinna, or may be located elsewhere within the module.

At least three major benefits are provided through use of the hearing aid module of the present invention: (1) visibility of the hearing aid is reduced or eliminated; (2) user comfort is increased because occlusion of the ear canal is unnecessary and because the volume of the hearing aid that typically sits behind the pinna is reduced or eliminated; and (3) by moving the transducer to the distal end of the module (so as to reside close to or in the ear canal when the module is inserted into the tunnel or tube), and by placing the microphone at or just outside the proximal end of the module (so as to reside behind the pinna of the ear) or within the module, feedback is greatly reduced and higher amplification of the sensed signal(s) is possible.

In one embodiment, a chronically implanted tube is first placed in the retro-auricular-space-to-ear-canal tunnel, and the hearing aid module of the present invention snugly fits inside the tube. In some embodiments, the tube is coated with a film or layer of steroid(s) or other drug(s) that, over time, minimize the risk of infection and/or inflammation.

In another embodiment, an acutely implanted tube, which may be coated with a steroid(s) or drug(s), is placed in the retro-auricular-space-to-ear-canal tunnel, and the hearing aid module of the present invention snugly fits inside the tube. After a suitable time, the tube may be removed and the hearing aid module, which may be coated with a steroid(s) or drug(s), placed directly into the tunnel.

In yet another embodiment, the hearing aid module, housed in a tube-like casing, is snugly inserted into the retro-auricular-space-to-ear-canal tunnel, with the speaker located near the ear canal, and the microphone located in the retro-auricular space behind the pinna or within the module.

The hearing aid module is preferably encapsulated or carried in an elongate flexible or rigid case or plug that is adapted to snugly slide into the implanted tube or retro-auricular-space-to-ear-canal tunnel. Such construction facilitates insertion and removal of the module into and from the tube or tunnel for the purpose of replacing or recharging the power source, or replacing the module with a new module.

In accordance with one aspect of the invention, users of the hearing aid module would preferably have at least two such modules—one module which is inserted into the retro-auricular-space-to-ear-canal tunnel or tube, and which provides the hearing aid function of the invention; and at least one other module that serves as a spare. The power source of the spare module(s) may advantageously be replaced, replenished, or recharged when not in use.

In some embodiments, the signal processing circuitry processes signals received by the microphone so the sounds emitting from the speaker are compatible with the sounds traveling naturally through ear canal. The signal processing circuits may also contain circuitry that performs other electronic or signal processing functions, such as voice command recognition.

In additional embodiments, telemetry circuits and/or connector(s) allow communication with external devices, such as an external programmer, remote control unit, telephone land line or cellular network (e.g., a USTM network), computer, CD player, AM/FM and/or two way radio.

BRIEF DESCRIPTION OF THE DRAWINGS

The above and other aspects of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1:
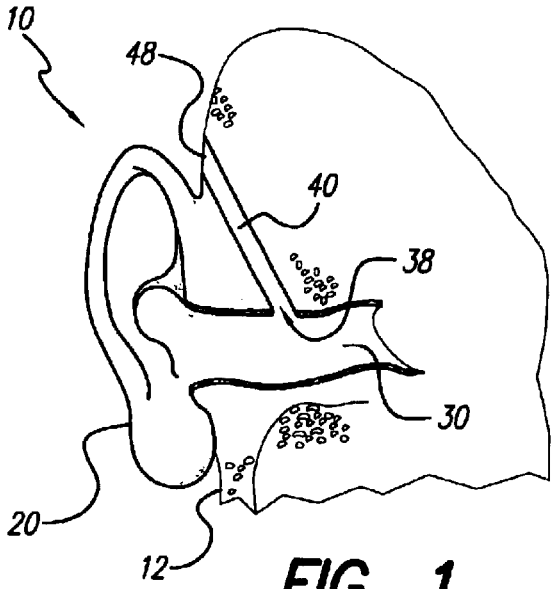
FIG. 1 schematically shows the location of a tunnel made through soft tissue to connect the retro-auricular space with the ear canal, and wherein, in one embodiment, a chronically implanted tube may be placed in such tunnel.
Figure 2:
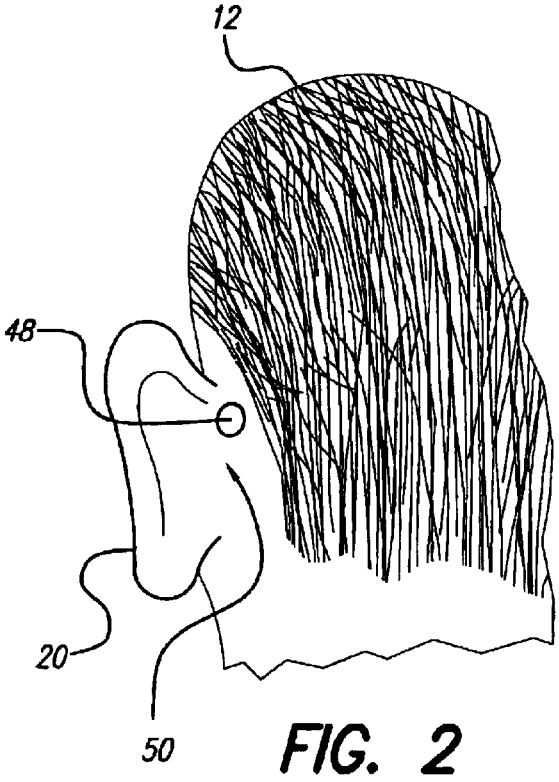
FIG. 2 depicts the end of the tunnel as it opens to the retro-auricular space behind the pinna.

Turning first to FIGS. 1 and 2, there is shown a schematic representation of an ear 10 attached to the head 12 of a user of the present invention (or a patient who benefits from use of the present invention). FIG. 1 is a front view of the ear 10, i.e., as seen when looking at the front of the head (i.e., face) of the user, whereas FIG. 2 is a view of the ear 10 as seen when looking at the back of the user's head. The ear 10 has a pinna 20 (a.k.a. auricle) and an ear canal 30. The space behind the pinna 20 is known as the retro-auricular space 50. Advantageously, the retro-auricular space 50 is generally a hidden space, not readily seen or observed when others look at the user.

In accordance with the present invention, a small tunnel 40 is made through soft tissue to connect the retro-auricular space 50 with the ear canal 30. Such tunnel 40 may be referred to as the "ear-canal-to-retro-auricular-space tunnel". Such tunnel-making is readily accomplished because the tissue is very soft in this region, and the process is medically a relatively simple procedure, being essentially a body-piercing operation. The tunnel 40 need not be very long, e.g., on the order of about 7–25 mm in length, and about 2–6 mm in diameter, depending upon the dimensions of the patient's ear in whom the tunnel is made.

For purposes of the present invention, the point at which the tunnel 40 opens into the retro-auricular space 50 is referred to as opening 48, and may also be referred to as the "external opening" or the "proximal end" of tunnel 40. Similarly, the point at which tunnel 40 opens into the ear canal 30 is referred to as opening 38, and may also be referred to as the "internal opening", "ear-canal opening" or "distal end" of the tunnel 40.

Figure 3A:
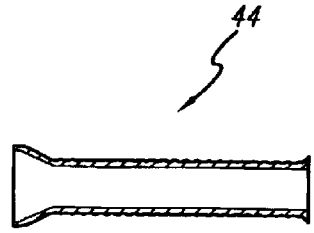
FIG. 3A shows the outline of a tube that may, in some embodiments of the invention, be inserted into the ear-canal-to-retro-auricular-space tunnel.

As is known in the prior art discussed previously, a hollow tube 44, seen in FIG. 3A, may be implanted in tunnel 40. In accordance with various embodiments of the present invention, such tube implantation may be chronic (intended for a long duration, e.g., permanent) or acute (intended for a short duration, e.g., temporary). The tube 44, when used, keeps the tunnel open and prevents tissue from collapsing or growing back into the tunnel 40. Such tube must be made from a body compatible material, such as Teflon, silicone, ceramic, stainless steel, titanium, or a polymer material. Further, such tube may assume a variety of shapes, e.g., cylindrical, oval, rectangular, or other shape. The tube may further consist of several parts that connect together to allow easy surgical placement, whereby the overall length of the tube may be variable. As discussed in detail presently, all or part of the tube may be hollow.

Figure 3B:
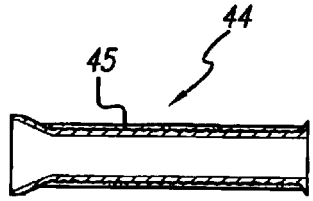
FIG. 3B shows the tube of FIG. 3A coated with a steroid or drug.

In accordance with one advantageous embodiment of the invention, and as shown in FIG. 3B, the tube 44 may be coated with a layer 45 of a steroid(s) or other drug(s) adapted to minimize the risk of infection and/or inflammation. As used herein, steroids or drugs include, but are not limited to anti-inflammatories, antibiotics, and other such beneficial drugs and substances. Such steroids or drugs may be encapsulated in a film or coating 45 designed to slowly release the steroids or drugs over a relatively long period of time, e.g., several days or weeks, thereby preventing or minimizing infection and/or inflammation during the time the tissue around the tunnel 40 heals. Representative substances or compounds that may be used to coat the tube in accordance with this aspect of the invention include steroids, such as a corticosteroid (e.g., corticosterone, cortisone, and aldosterone) or other drugs, either naturally occurring or synthetic, that prevent, minimize, and/or treat infection and/or inflammation.

A hearing aid module 60, discussed more fully below in conjunction with the description of FIGS. 4, 5, 6A, and 6B, may be inserted into the tube 44 so that a proximal end of the module 60 resides at the opening 48, and a distal end of the module 60 resides at the opening 38. The module 60 is housed in a tubular case that is sized to fit snugly within the tube 44. Advantageously, the module 60 may be readily inserted into, or removed from, the tube 44, thereby allowing the user to replace or remove the module when needed, e.g., to replace or recharge its battery or other power source.

In other embodiments of the invention, a separate tube 44 need not first be inserted into the ear-canal-to-retro-auricular-space tunnel 40. Rather, the hearing aid module 60, housed in a tubular case and sized so as to fit snugly within the tunnel 40, may simply be inserted into the tunnel 40, with a proximal end of the module 60 being located at the opening 48 of the tunnel, and with a distal end of the module 60 being positioned at the opening 38 of the tunnel.

Alternatively, tube 44 may be inserted into tunnel 40 temporarily or acutely, e.g., until the tissue has healed and likelihood of infection has passed, at which time, tube 44 may be removed and module 60 inserted. Advantageously, module 60 may be inserted into tube 44 during the time the tissue is healing.

Figure 4:
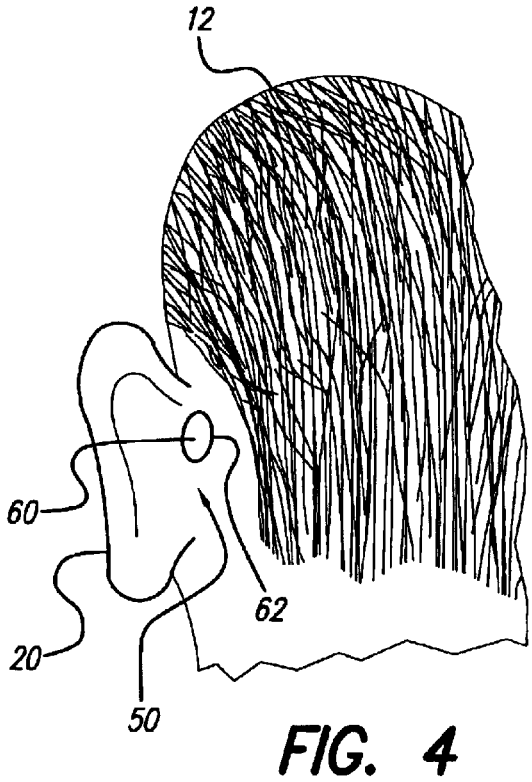
FIG. 4 depicts the space behind the pinna, as in FIG. 2, but with the hearing aid module of the present invention inserted into the tunnel so that the microphone is positioned in the retro-auricular space.

Turning next to FIG. 4, there is shown a back view of the ear 10, as is also shown in FIG. 2, but in FIG. 4 there is a hearing aid module 60 made in accordance with the present invention inserted into the tunnel 40 (or tube 44, when used), so that a proximal end 62 of the module 60 resides in the retro-auricular space 50, and a distal end of the module 60 (not seen in FIG. 4) is positioned adjacent the distal end 38 of the tunnel 40.

Figure 5:
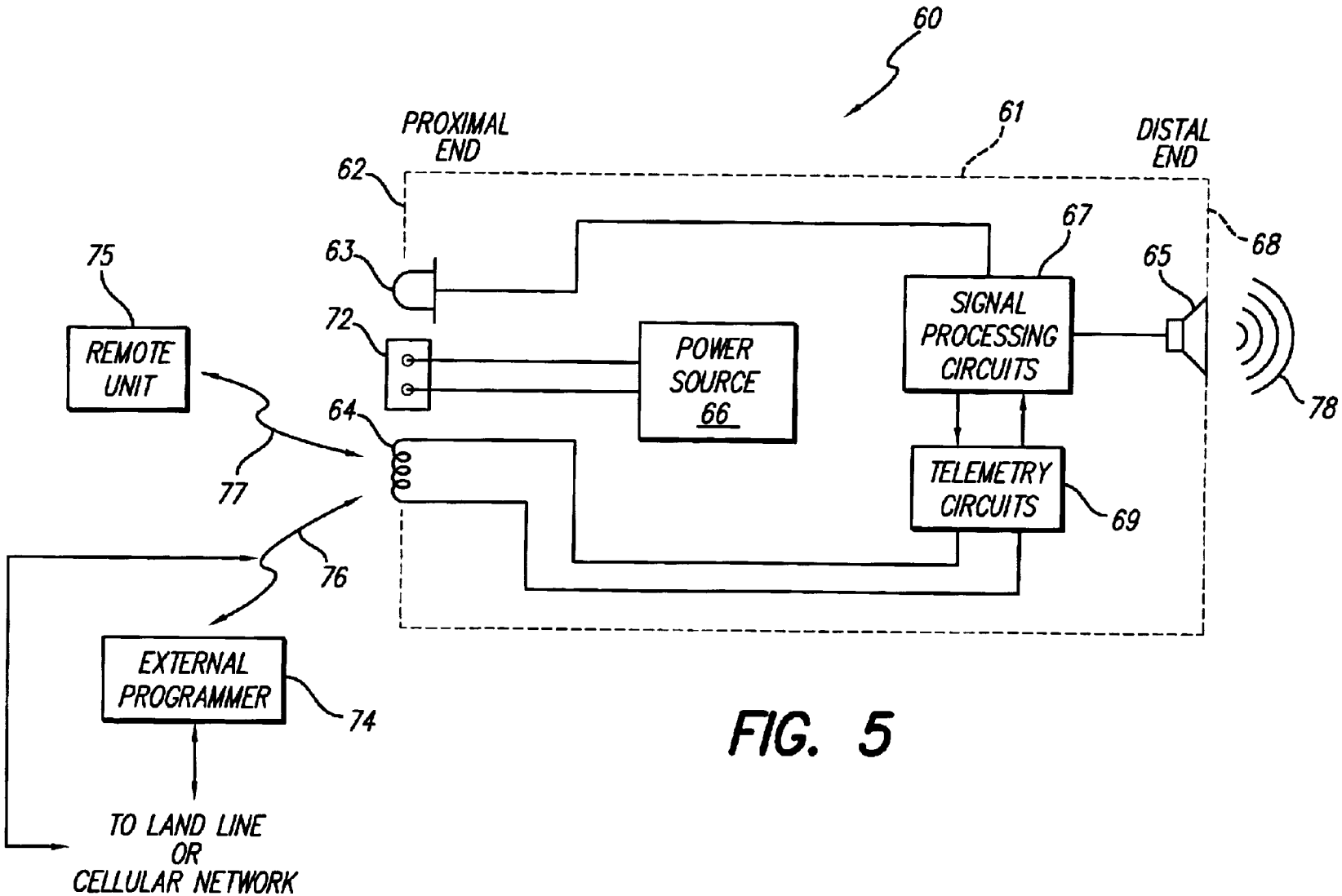
FIG. 5 is an electrical block diagram of the hearing aid module of the present invention.

FIG. 5 is an electrical block diagram of the hearing aid module 60 of the present invention. The module 60 is preferably housed or encapsulated within a tubular (or other suitably-shaped) case 61. A microphone 63 and an antenna coil 64 are located at a proximal end 62 of the module 60. An acoustic transducer 65, e.g., a speaker, is located at a distal end 68 of the module 60.

Between the proximal end 62 and distal end 68 of hearing aid module 60 is a power source 66, signal processing circuits 67, and telemetry circuits 69. A suitable connector 72 is also formed within case 61 to enable connection with power source 66, enabling the power source to be replenished and/or recharged when module 60 is removed from tunnel 40 (or tube 44), or possibly even while module 60 remains in tunnel 40 or tube 44.

As seen in FIG. 5, the microphone 63 is connected to the signal processing circuitry 67. The speaker 65 is also connected to the signal processing circuitry 67. Such signal processing circuitry includes amplification, filtering, and other signal processing circuits so that sounds sensed through the microphone 63 (which sensed sounds are transduced by the microphone into electrical signals) may be suitably amplified and filtered and presented to the speaker 65 and/or telemetry circuitry 69. In addition, if required, the signal processing circuitry 67 will process the signals received by the microphone 63 so that the sounds emitting from speaker 65 are compatible (e.g., temporally matched) with the sounds traveling naturally through ear canal 30. Optionally, the signal processing circuits may also contain circuitry that performs other electronic or signal processing functions, such as voice command recognition.

The telemetry circuitry 69 may be coupled through antenna 64 with an external programming unit 74 by way of a suitable telecommunications link 76, e.g., a radio frequency (RF) link, and/or with a remote control unit 75 by way of a suitable RF (or other) link 77. The external programming unit 74 is typically (but not necessarily) operated by an audiologist, or other medical personnel, who assist the user in initially programming the hearing aid module, or with subsequent adjustments to the programming of the hearing aid module after some amount of use, so that it best suits and meets the needs and preferences of the user. Programming may include adjusting the module to utilize a desired frequency response or signal processing strategy. The external programming unit may optionally be connected to or linked through a telephone land line, or wireless cellular network, or other wireless communications network, in order to allow someone, e.g., personnel at a remote medical facility or health care clinic, to assist in the programming operation.

One possible RF telecommunications link that may be used for the links 76 and/or 77 is known as Bluetooth. A Bluetooth link advantageously has an identification (ID) code for each device incorporated into its protocol.

Ambient sounds sensed through the microphone 63 are processed by the signal processing circuitry 67 and presented to the speaker 65. The speaker 65 is a transducer that transduces the electrical signals received into audio sound waves 78. Such audio sound waves 78 then propagate into the ear canal 30 at the proximal end 38 of the tunnel 40, where they can be readily heard by the user.

Sounds spoken by the user may also be sensed by the microphone 63, amplified and processed by the sound and signal processing circuits 67, and presented to the telemetry circuits 69, where they can be transmitted to the external programming unit 74 through the telecommunications link 76, if necessary, or directly to or through a telephone land line or wireless network, where they may be further transferred to medical personnel, or other individuals, at a remote location, over the land line or cellular link network.

Because of the features described above that allow a user to be telecommunicatively coupled with a land line or cellular network, the present invention also lends itself for use with the next generation cell phone protocol (USTM), which cell phone protocol will start being used in Europe soon. With such protocol, a connection may be established between the "phone" (which would typically be the programmer station 74 shown in FIG. 5; but which could, in some embodiments, be the telemetry circuits 69 carried in module 60) and the USTM network. A user of the USTM network is charged based on the amount of information transmitted, or (in some instances) may be charged a flat monthly fee or weekly fee.

Through the USTM network, numerous internet-related features are made possible. For example, employing the USTM protocol, a user has the ability to write, send and receive email, connect to the internet and search for and receive information, as well as conduct a conventional telephone call.

As indicated above, the primary function of the hearing aid module 60 is as a hearing aid device. That is, sounds sensed through the microphone 63 are amplified, filtered and processed by the signal processing circuitry 67 and presented to the speaker 65. Any type of signal processing may be employed, as is known in the hearing aid art (e.g., different frequency responses), in order to enhance the ability of the user to benefit from the sound amplification. Different signal processing strategies may be selected through the external programmer, and may be modified, from time to time, as needed or desired. The speaker 65 transduces the electrical signals received from the signal processing circuits 67 into audio sound waves 78. Such audio sound waves 78 then propagate into the ear canal 30 at the proximal end 38 of the tunnel 40, where they can be readily heard by the user.

The wireless remote control unit 75 may also be used with the hearing aid module 60 in order to allow the user to control, to a limited extent, the operation of the signal processing circuits 67. In a preferred embodiment, such remote control unit 75 includes means for establishing the telemetry link 77 with the telemetry circuits 69 of the module 60 through the antenna coil 64. Once such a link 77 is established, the user may control certain parameters associated with the operation of the module 60, such as the amplitude of the signal 78 that is emitted from the acoustic transducer 65 (i.e., volume control), or the frequencies of the signals (i.e., tone control) that are allowed to be emitted from the acoustic transducer 65. The link 77 may be an RF link. Alternatively, in some embodiments, the link 77 may be another type of link, such as an infrared link, or a magnetic link.

In one preferred embodiment, the signals that are sent and received by the telemetry circuits 69 are coded in a way that only designated target and source devices can be linked through the telemetry links 76 or 77.

Figure 6A:
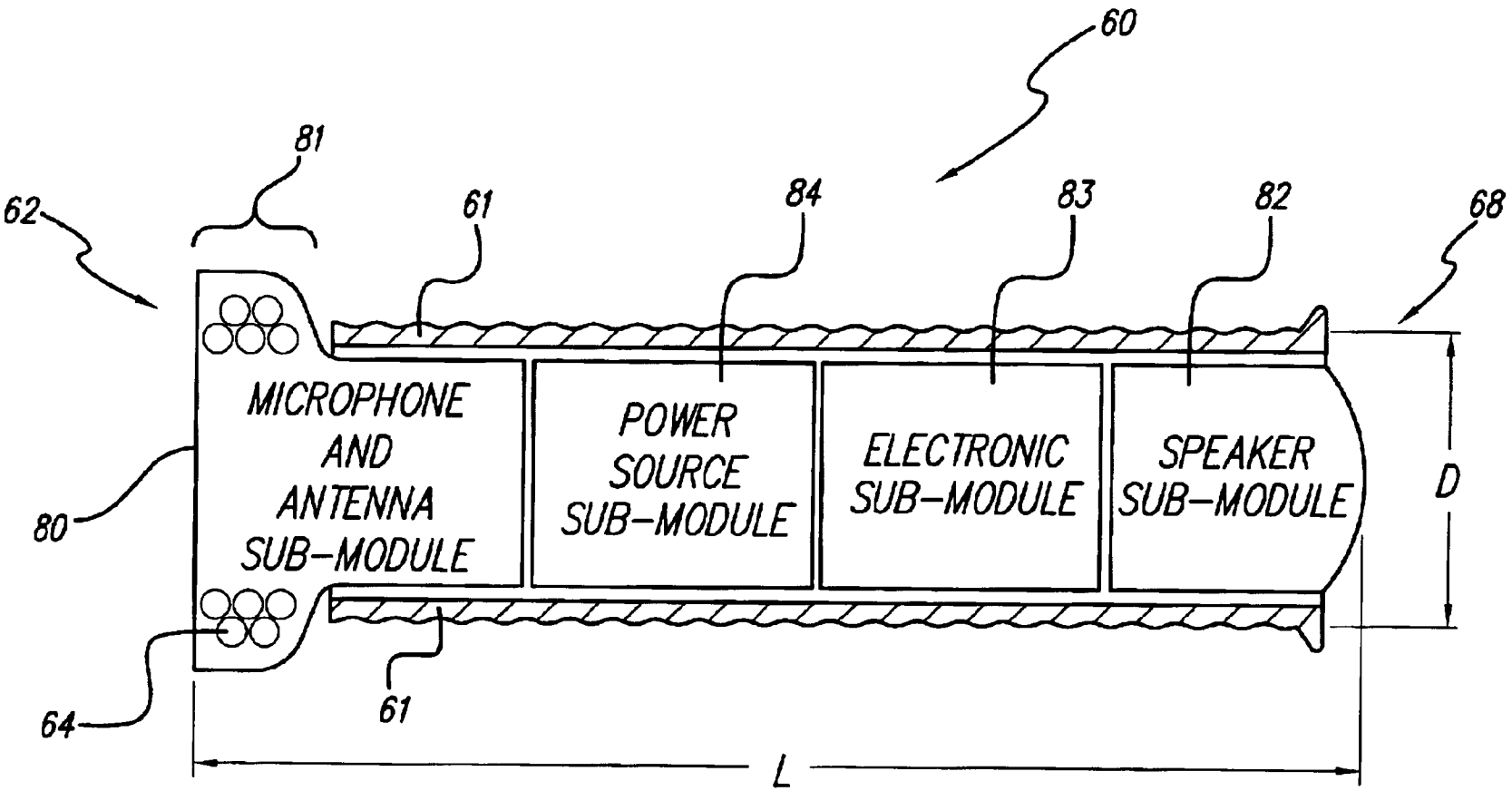
FIG. 6A illustrates one embodiment of the hearing aid module of the present invention.

Turning next to FIG. 6A, a representative packaging scheme for the hearing aid module 60 is illustrated. The case 61 of the module 60, in this instance is tubular in shape. Case 61 may have a ribbed, scored, or otherwise roughened outer side wall, which may be preferable when inserted directly into tunnel 40, or may have a smooth outer side wall, which may be preferable when inserted into tube 44.

Figure 6B:
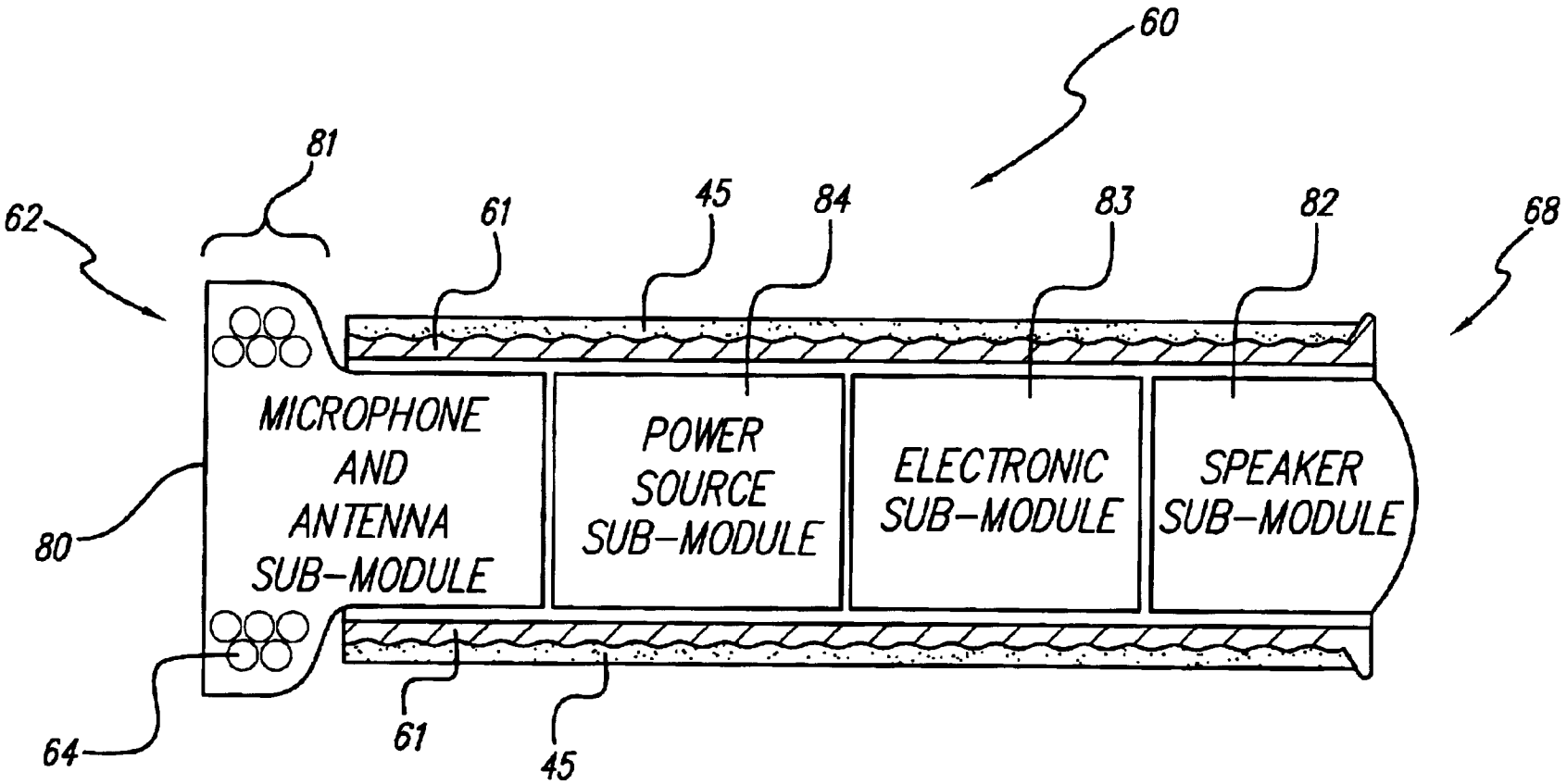
FIG. 6B shows the module of FIG. 6A coated with a steroid or drug.

In accordance with one advantageous embodiment of the invention, and as shown in FIG. 6B, case 61 may be coated with a layer 45 of a steroid(s) or other drug(s) adapted to minimize the risk of infection and/or inflammation. As in the earlier discussion of coating tube 44, the steroid(s) or drug(s) may be embedded in a suitable carrier substance that dissolves over time, thereby eluting or dispensing the drugs or steroids to the surrounding tissue over a period of time.

The case 61 has a diameter D sized to fit snugly within tunnel 40 or tube 44. Further, case 61 has a length L such that when module 60 is properly inserted into the tunnel 40, or tube 44, the proximal end 62 of the module 60 will be located near the proximal end 48 of the tunnel 40, and the distal end 68 of the module 60 will be near the distal end 38 of the tunnel 40. The case 61 may be made from any suitable material, such as metal, silicone rubber, Silastic, or other suitable polymer.

For the embodiments illustrated in FIGS. 6A and 6B, there are four sub-modules end-to-end inside tubular case 61. At the proximal end 62 of module 60 is a microphone and antenna sub-module. In order to facilitate handling of module 60, and in particular to facilitate removing the module 60 from tunnel 40 or tube 44, the microphone and antenna sub-module 80 has a head portion 81. The head portion 81, like the head of a pin or the head of a nail, allows a user to physically grasp the head portion during insertion or removal in order to apply the necessary insertion or removal forces to the module. In one embodiment, coil windings of the antenna 64 are physically located within the head portion 81.

In some embodiments, a connector may be located at the proximal end 62 of module 60 into which a microphone may be connected, which microphone may be located remotely, e.g., clipped to the user's clothing. The connector may also serve as an input to an external signal source, such as an AM/FM radio, an intercom, a CD player, etc. Such a connector may further serve the function of connector 72 shown in FIG. 5, i.e., as an input to an external power source. Alternatively, telemetry circuits 69 may be used for such input.

At the distal end 68 of tubular case 61 of hearing aid module 60 is a speaker sub-module 82. An electronic sub-module 83 and a power source sub-module 84 fill the remaining space within case 61. The electronic sub-module includes the signal processing circuits 67 and telemetry circuits 69. The power source module 84 includes a suitable power source, such as a rechargeable battery and/or super capacitor, and associated charging/replenishing circuitry. The charging/replenishing circuitry may, in some embodiments, be found in the electronic sub-module 83 rather than within the power source module 84. The power source may comprise a rechargeable battery of the same or similar type as is disclosed, e.g., in U.S. Pat. Nos. 6,185,452; 6,164,284; and/or 6,208,894, which patents are incorporated herein by reference.

In an alternative packaging scheme for hearing aid module 60, microphone 63 may be positioned at a distance 0.5 L (see FIG. 6A), or less, from speaker 65. In such a case, power source sub-module 84 and electronic sub-module 83 would be further miniaturized in order to be positioned between microphone 63 and speaker sub-module 82. Similarly, antenna 64, rather than being positioned in head portion 81, may be positioned in other locations within module 60; for instance, antenna 64 may be built into case 61. In such embodiments, head portion 81 may remain at the proximal end 62 of module 60, for instance, built into case 61, in order to facilitate handling of module 60.

In such embodiments with microphone 63 positioned 0.5 L or less from speaker 65, signal processing circuits 67 will process the signals received by microphone 63 as required to account for effects of the position of microphone 63 within case 61. In addition, as mentioned earlier, the signal processing circuitry 67 will, if required, process the signals received by the microphone 63 so that the sounds emitting from speaker 65 are compatible (e.g., temporally matched) to augment the sounds traveling naturally through ear canal 30.

While the invention herein disclosed has been described by means of specific embodiments and applications thereof, numerous modifications and variations could be made thereto by those skilled in the art without departing from the scope of the invention set forth in the claims.

What is claimed is:

1. A hearing aid adapted for insertion into a tunnel that connects a retro-auricular space to an ear canal, comprising:

a hearing aid module comprising:

a case;

electronic circuitry housed in said case;

an acoustic transducer electrically connected to said electronic circuitry;

a microphone also electrically connected to said electronic circuitry; and a power source housed in said case end electrically connected to the electronic circuitry;

a hollow tube adapted for insertion into the tunnel, wherein the case of the hearing aid module is adapted to be slidably inserted into and withdrawn from said tube;

wherein the electronic circuitry includes signal processing circuitry for amplifying and processing signals sensed through the microphone and for presenting the amplified and processed signals to the acoustic transducer; and wherein the acoustic transducer converts the amplified and processed signals received from the electronic circuitry to sound waves, which sound waves are emitted towards the ear canal.

2. The hearing aid module of claim 1 further comprising signal processing circuitry for processing sensed signals and presenting processed signals that are compatible with sounds traveling naturally through the ear canal.

3. The hearing aid module of claim 1 further comprising signal processing circuitry that performs voice command recognition.

4. The hearing aid module of claim 1 further comprising a coating on the case, which coating contains a steroid or drug.

5. The hearing aid of claim 1 further comprising a coating on the tube, which coating contain, a steroid or drug.

6. The hearing aid module of claim 1 wherein said acoustic transducer is located atm distal end of said case and said microphone is located at a proximal end of said case.

7. The hearing aid module of claim 1 wherein said acoustic transducer is located at a distal end of said case and said microphone is located remotely from the hearing aid module.

8. The hearing aid module of claim 1 wherein said microphone is located between distal and proximal ends of the case, about halfway there between or closer to the distal end of said case.

9. The hearing aid module of claim 1 further including telemetry circuitry housed in said case, which telemetry circuitry includes a wireless link over which communicative signals may be transmitted to the hearing aid module from a remote location.

10. The hearing aid module of claim 1 further including telemetry circuitry housed in said case, which telemetry circuitry transmits to a remote location sounds spoken by the user, sensed by the microphone, and processed by the signal processing circuits.

11. The hearing aid module of claim 1 further including telemetry circuitry housed in said case, which telemetry circuitry sends and receives signals that are coded so only designated target and source devices can be linked to the telemetry circuitry.

12. The hearing aid or claim 1 further including means for allowing the user to adjust the volume of the sound waves emitted from the acoustic transducer.

13. The hearing aid or claim 12 further including means for allowing the user to adjust the frequency content of the sound waves emitted from the acoustic transducer.

14. The hearing aid module of claim 1 wherein the power source comprises a rechargeable battery.

15. The hearing aid module of claim 1 wherein the power source comprises a super capacitor.

16. The hearing aid of claim 1 further including an external programming unit coupled to the hearing aid through a suitable communications link.

17. The hearing aid of claim 16 further including the external programming unit coupled with a remote location through an existing telecommunications network.

18. The hearing aid module or claim 1 further comprising a cable connector adapted for communications with at least one external device.

19. The hearing aid module of claim 18 wherein the at least one external device comprises an external power source, an external programming unit, a remote control unit, a remote microphone, and an external signal source.

20. A hearing aid module adapted for insertion into a tunnel connecting a retro-auricular space to an ear canal, comprising:

a case;

a hollow tube adapted for insertion into the tunnel, wherein the case is adapted to be slidably inserted into and withdrawn from said tube;

means contained in said case for processing electrical signals representing sound wave;

means for sensing sound waves;

means for transducing said sound waves into electrical signals and for providing said signals to the processing means, which transducing means are electrically connected to the sensing means and the processing means;

means for converting said processed signals received from the processing means to sound waves and for emitting such sound waves towards the ear canal; and means for providing power to said module electrically connected to at least the electronic circuitry.

21. A method of aiding the hearing function of user, comprising:

making a tunnel through soft tissue of the user that connects a retro-auricular space behind a pinna with an ear canal;

inserting inside the tunnel a hearing aid module, the hearing aid module having a case adapted for insertion into the tunnel, with an acoustic transducer located at a distil end of the module so as to be near the ear canal, a microphone located at a proximal end of the module so as to be near the retro-auricular space, and a power source and signal processing circuits located within the module;

wherein inserting the hearing aid module further comprises inserting the hearing aid module into a tube and inserting the tube inside the tunnel.

22. The method of claim 21 further comprising coating the hearing aid module with a coating containing a drug or steroid.

23. The method of claim 21 further comprising coating the tube with a coating containing a drug or steroid.

24. The method of claim 21 further comprising removing the tube after a period of time for the tissue to heal and re-inserting the hearing aid module without the tube.

25. The method of claim 21 further comprising processing signals so that sound waves from said acoustic transducer are compatible with sounds traveling naturally through the ear canal.

26. The method of claim 21 further comprising transmitting signals to the hearing aid module from a remote location.

27. The method of claim 26 further comprising transmitting signals via a wireless network.

28. The method of claim 26 further comprising transmitting signals via a cable connected to the hearing aid module.

29. The method of claim 21 further comprising controlling and programming the hearing aid module via at least one wireless communications link with at least one remote device.

* * * * *